US006505983B1

(12) United States Patent
Seo

(10) Patent No.: US 6,505,983 B1
(45) Date of Patent: Jan. 14, 2003

(54) BRUSH COUPLED TO HAIRDYE EJECTING APPARATUS

(75) Inventor: Dong Kook Seo, Seoul (KR)

(73) Assignee: Esther Cos. Co., Ltd. (KR)

( * ) Notice: Subject to any disclaimer, the term of this patent is extended or adjusted under 35 U.S.C. 154(b) by 0 days.

(21) Appl. No.: 09/991,668

(22) Filed: Nov. 16, 2001

(51) Int. Cl.[7] ..... A46B 11/00

(52) U.S. Cl. ..... 401/47; 401/44; 401/190; 132/113; 132/114; 132/208

(58) Field of Search ..... 401/47, 44, 190, 401/270, 282, 286, 289; 132/112, 113, 114, 116, 148, 208

(56) References Cited

U.S. PATENT DOCUMENTS 3,236,457 A * 2/1966 Kennedy et al. ..... 401/190
3,961,635 A * 6/1976 Miya ..... 401/190
6,168,335 B1 * 1/2001 Mears et al. ..... 401/190

FOREIGN PATENT DOCUMENTS

FR 1353494 * 12/1969 ..... 401/190

* cited by examiner

*Primary Examiner*—David J. Walczak
(74) *Attorney, Agent, or Firm*—Warner Norcross & Judd

(57) ABSTRACT

A brush coupled to a hairdye ejecting apparatus in which a first hairdye and a second hairdye are simultaneously ejected from a pair of storing vessels to dye or to decolorize the hairs. The first hairdye and the second hairdye can be ejected in a combination of them, thereby making it possible to dye or decolorize the hairs by only one stroke of the brush. In the brush coupled to a hairdye ejecting apparatus according to the present invention, if a push button 18 is pressed, a pair of levers 28 are pivoted downward to push down a pair of blocks 15. Then the pair of the blocks 15 press down a pair nozzles 11*b* of a tank 11, with the result that the hairdyes are supplied into the blocks 15. Then the hairdyes are supplied to a hairdye collecting member 16 where the hairdyes are mixed together. Then the mixed hairdyes pass through a guide pipe 17, a conduit 33, and a plurality of branch conduits 33*a* so as to be ultimately ejected through outlets 35*a* of hairdye ejecting comb blades 35 to the hairs of the user.

5 Claims, 8 Drawing Sheets

BRUSH COUPLED TO HAIRDYE EJECTING APPARATUS

FIELD OF THE INVENTION

The present invention relates to a brush coupled to a hairdye ejecting apparatus, in which a first hairdye and a second hairdye are simultaneously ejected from a pair of storing vessels to dye or to decolorize hairs. Particularly, the present invention relates to a brush coupled to a hairdye ejecting apparatus, in which the first hairdye and the second hairdye can be ejected in a combination of them, thereby making it possible to dye or decolorize the hairs by only one stroke of the brush.

BACKGROUND OF THE INVENTION

Generally, in order to obtain a desired color of hairs, the hairs are dyed or decolorized, or dyed again after a decolorizing. Under this condition, in dying or decolorizing the hairs, a first hair dye and a second hair dye are sequentially applied, or the first and second hair dyes are mixed together manually before using them.

Thus, the first hairdye and the second hairdye are extruded from the respective storing tubes to mix them together. Then the mixture is uniformly spread on the hairs by stroking a comb or a toothbrush through the hairs.

However, in this hair-dying method in which the hairs are dyed or decolorized by using the first and second hairdyes, the first and second hairdyes have to be mixed by using a tool, thereby making the operation troublesome. Further, once the hairdyes are mixed together, the portion which remains after use has to be discarded.

Further, the portions of the hairdyes, which remain in the tubes, are chromatically faded upon being exposed to the air, and therefore, they have to be used within about one month. Further, the hair-dying is impossible for oneself, and therefore, another person has to help it, thereby making the hair-dying troublesome.

The Korean Utility Model Publication No. 1997–1299 recently disclosed a technique to overcome the above described problems. In this technique, a brush 1 is secured to a hairdye-containing vessel 10, and if a button 4 is pressed, then the hairdye of the vessel 10 is ejected to the brush 1, thereby making it possible to dye or decolorize the hairs.

In this technique, the hairdye containing vessel and the brush are unitized together, although a single kind of hairdye is used. Therefore, the dye or decolorizing is possible by only carrying out combing, and therefore, one can dye or decolorize the hairs for oneself.

However, in view of the fact that a first and second hairdyes have to be used in a sequential manner, the first and second hairdyes have to be spread in a stepwise manner, this being a troublesome task.

So far, there has not been developed a technique in which the first and second hairdyes can be used at a single step. Accordingly, there has arisen a demand for an apparatus in which the first and second hairdyes can be applied to the hairs at a single step.

SUMMARY OF THE INVENTION

The present invention is intended to overcome the above described disadvantages of the conventional techniques.

Therefore it is an object of the present invention to provide a brush coupled to a hairdye ejecting apparatus, in which first and second hairdyes are respectively stored in a pair of storage vessels, and the first and second hairdyes are mixedly ejected through the blades of the brush, thereby making it possible to die or decolorize the hairs in a simple manner by one stroke of the brush.

In achieving the above object, the brush coupled to a hairdye ejecting apparatus according to the present invention includes: a tank consisting of a pair of storage rooms, and each of the storage rooms having a nozzle, the nozzle protruding from an outlet of each of the storage rooms; a nozzle pressing means installed at an outlet of the tank and having a flow path communicating to the nozzles, for imposing a pressure on the nozzles to eject the hairdyes; and a brush coupled to the nozzle pressing means, for ejecting the hair dyes by actuations of the nozzle pressing means.

The nozzle pressing means according to the present invention includes: a housing having a pair of through-guide holes for receiving the caps respectively, and assembled to an outlet part of the tank; a pair of blocks accommodated within the housing, a bottom and a side face of each of the block having a flow path in a protruding form, the flow path being connected to the nozzle of the tank; a hairdye collecting member disposed between the pair of the blocks, for being matched to outlets of the blocks to eject the hairdyes after receipt of them from the pair of the blocks; a guide pipe connected to an outlet of the hairdye collecting member, for guiding the hairdyes to the brush; and a push button mounted upon the pair of the blocks and having a push piece at its center and having levers on its sides, for pressing down the nozzles of the tank by the levers so as to eject the hairdyes.

The brush according to the present invention includes: a brush main body having a receiving slot on its side upper face, having a plurality of comb blades formed around the receiving slot, having a conduit formed between the receiving slot and a lower opening so as to communicate to the guide pipe and so as to make the hairdye flow to the receiving slot, and having a guide hole for making a push button protrude from a side; and a hairdye ejecting brush having a plurality of hairdye ejecting hollow blades, each of the blades having an outlet, the brush being detachably attached to the receiving slot of the brush main body to eject the hairdye.

BRIEF DESCRIPTION OF THE DRAWINGS

The above object and other advantages of the present invent ion will become more apparent by describing in detail the preferred embodiment of the present invention with reference to the attached drawings in which.

DETAILED DESCRIPTION OF THE PREFERRED EMBODIMENT

Now the present invention will be described in detail referring to the attached drawings.

Figure 1:
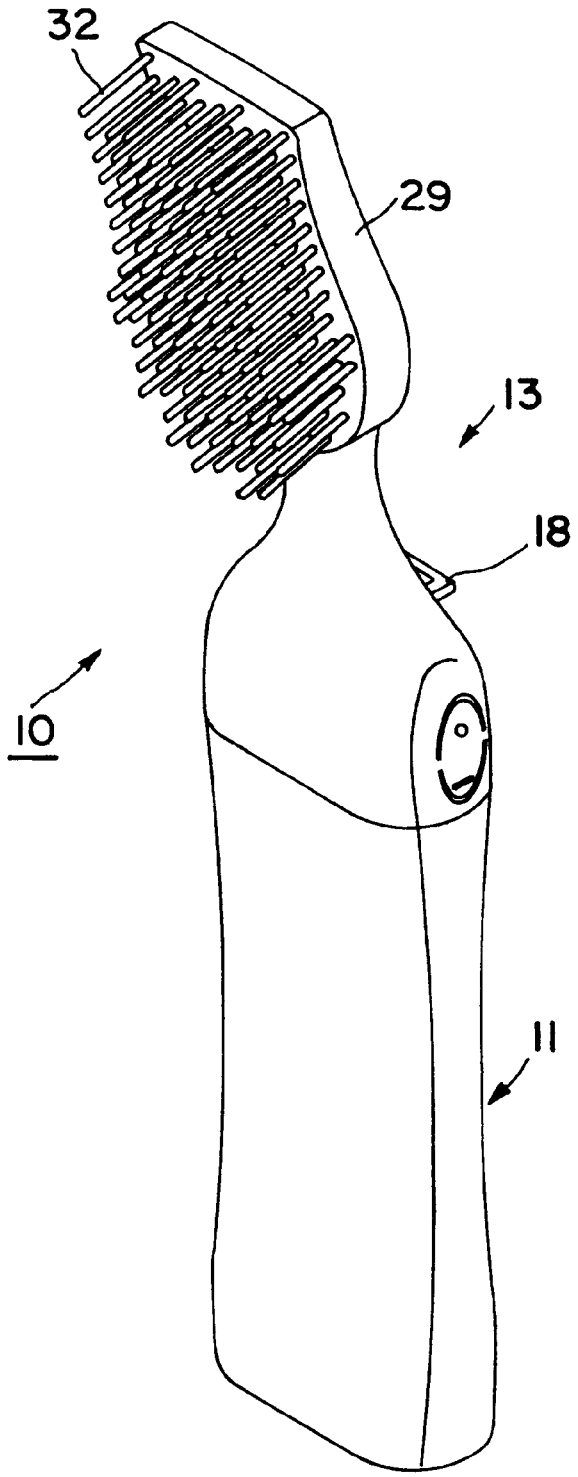
FIG. 1 is a perspective view of the brush according to the present invention.
Figure 2:
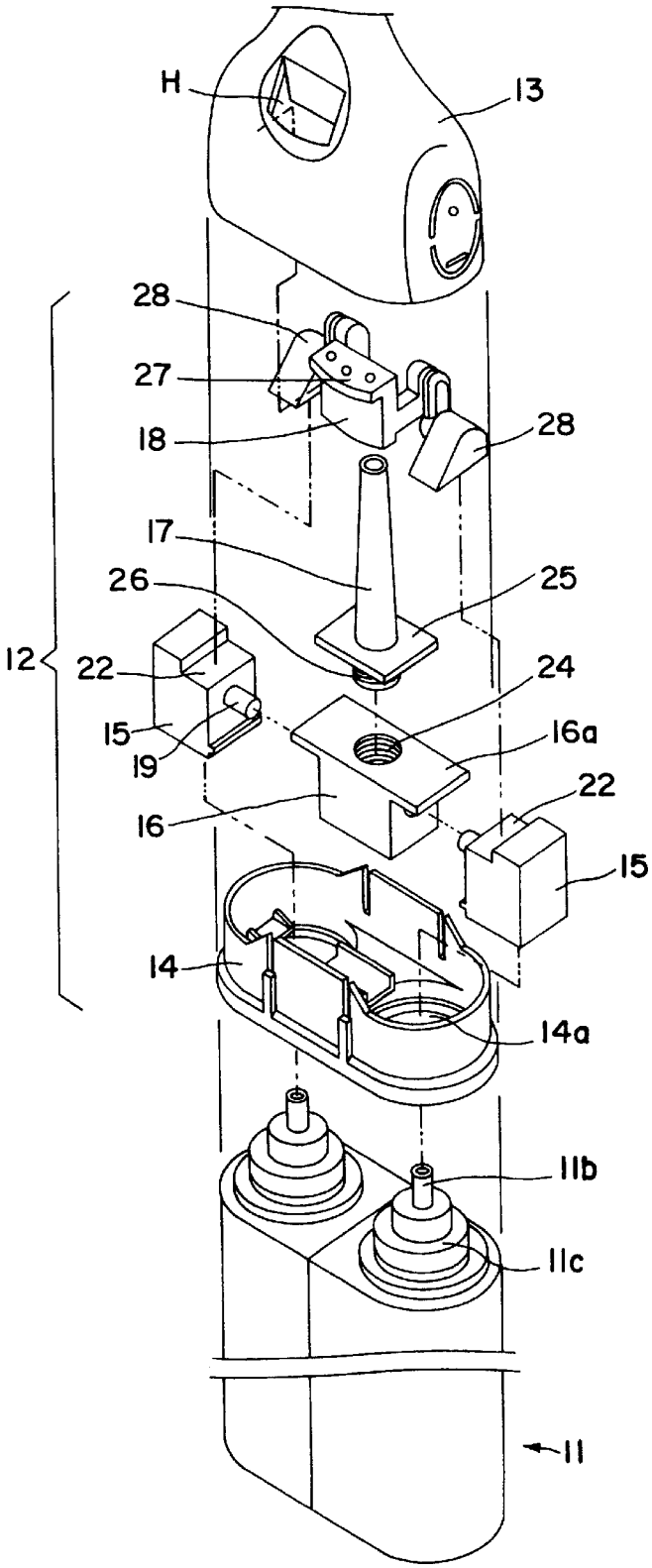
FIG. 2 is an exploded perspective view of the nozzle pressing means according to the present invention.
Figure 3:
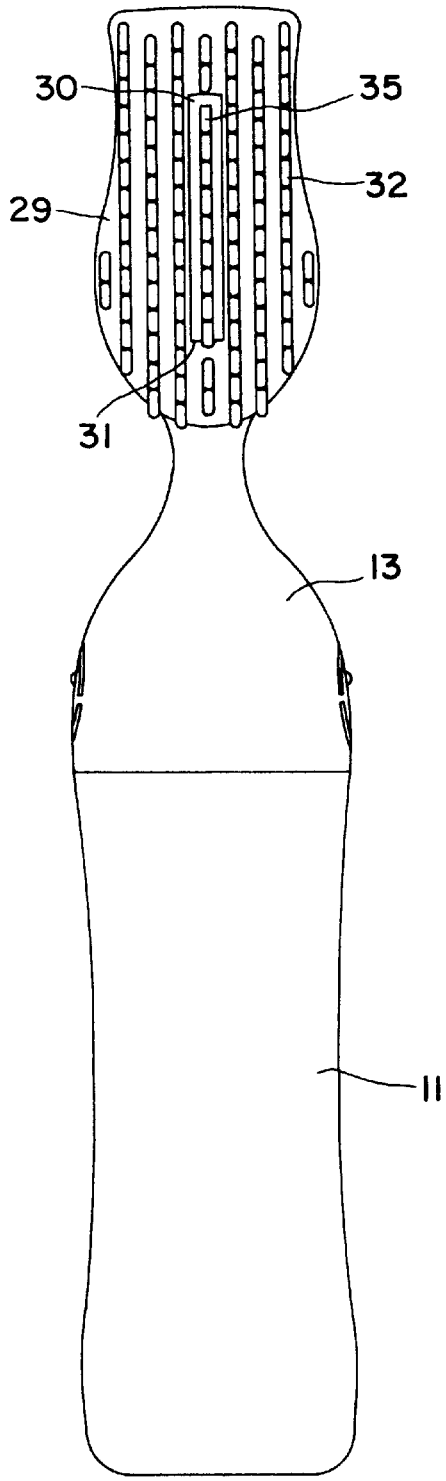
FIG. 3 is a frontal view of the brush according to the present invention.

FIG. 1 is a perspective view of the brush according to the present invention. FIG. 2 is an exploded perspective view of the nozzle pressing means according to the present invention. FIG. 3 is a frontal view of the brush according to the present invention.

As shown in these drawings, the brush 10 coupled to a hairdye ejecting apparatus according to the present invention includes: a tank 11 consisting of a pair of storage rooms 11*a,* and each of the storage rooms 11*a* having a nozzle 11*b;* a nozzle pressing means 12 installed at an outlet of the tank 11 and having a pair of flow paths communicating to the nozzles 11*b,* for imposing a pressure on the nozzles to eject the hairdyes; and a brush 13 coupled to the nozzle pressing means 12, for ejecting the hairdyes by actuations of the nozzle pressing means 12.

Figure 4:
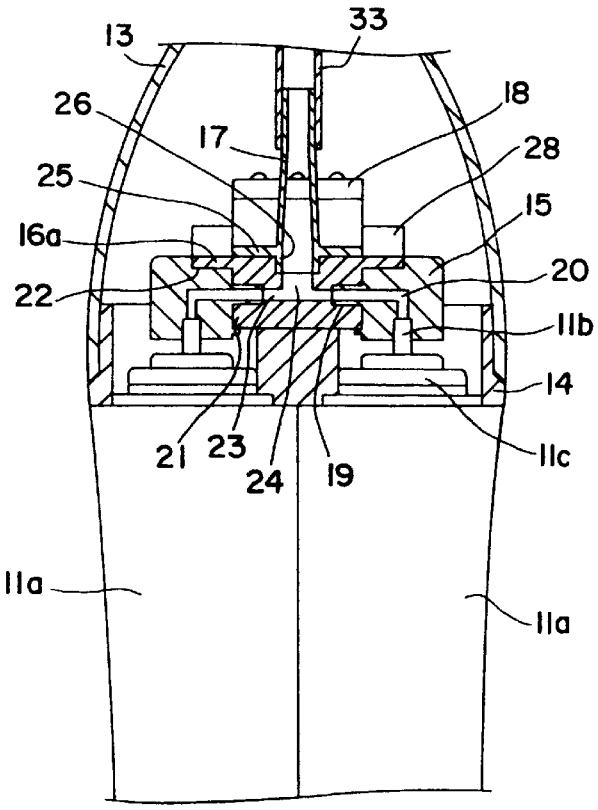
FIG. 4 is a frontal sectional view of an embodiment of the nozzle pressing means according to the present invention.
Figure 5:
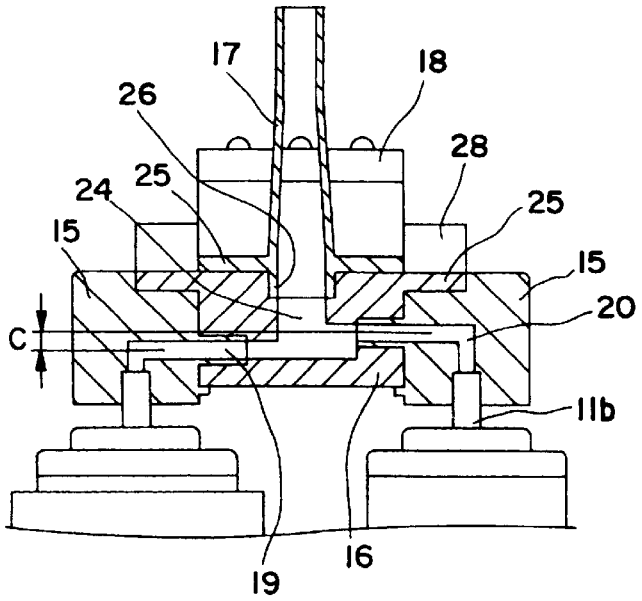
FIG. 5 is a frontal sectional view of another embodiment of the nozzle pressing means according to the present invention.
Figure 6:
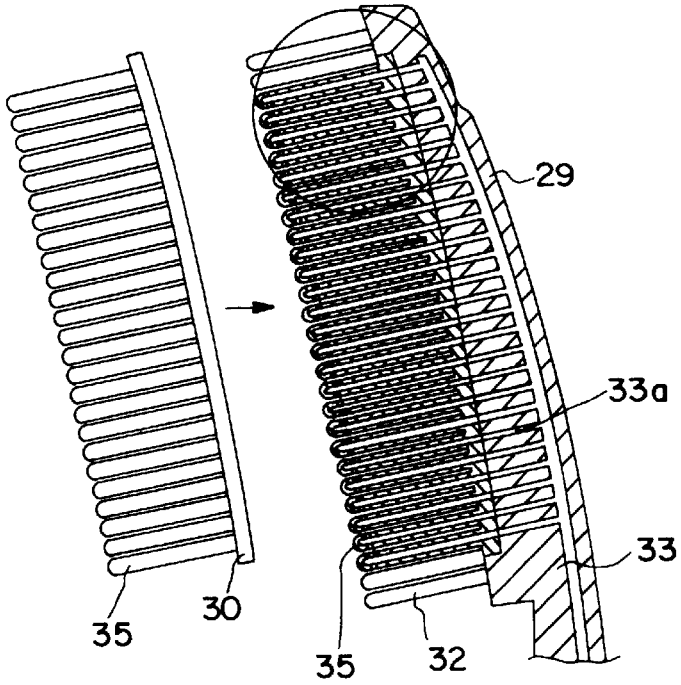
FIG. 6 is a perspective view of the assembled hairdye ejecting brush according to the present invention.

As shown in FIGS. 2, 4 and 5, the tank 11 consists of a pair of storage rooms 11*a* for storing a first hairdye and a second hairdye separately in each of them, and the outlet of the top of the storage room 11*a* is coupled to a cap 11*c* so as to be closed or opened.

From the cap 11*c,* there protrudes a nozzle 11*b,* and this nozzle 11*b* is slidable up and down. Thus when the nozzle 11*b* moves down by the pressure of the nozzle pressing means 12, the hairdye is ejected, while if the nozzle is restored to the original position, the ejection of the hairdye is blocked.

The constitution of the nozzle 11*b* is for example same as that of the portable gas container, and therefore, a description on it will be skipped here.

As shown in FIG. 4, the nozzle pressing means 12 for ejecting the hairdyes of the tank 11 includes: a housing 14 having a pair of through-guide holes 14*a* for receiving the caps 11*c* respectively, and assembled to an outlet part of the tank 11; a pair of blocks 15 accommodated within the housing 14, each block 15 having a flow path, the flow path being connected to the nozzle 11*b* of the tank 11; a hairdye collecting member 16 disposed between the pair of the blocks 15, for being matched to outlets of the blocks 15 to eject the hairdyes after receipt of them from the pair of the blocks 15; a guide pipe 17 connected to an outlet of the hairdye collecting member 16, for guiding the hairdyes to the brush 13; and a push button 18 mounted upon the pair of the blocks 15, for pressing down the nozzles 11*b* of the tank 11 so as to eject the hairdyes.

The bottom and sides of the block 15 communicate to the nozzle 11*b* of the tank 11 so as to make the hairdye flow through them. A discharge pipe 19 is formed to be connected to a guiding flow path 20. Beneath the discharge pipe 19 and on the block 15, there is formed an engaging step 21 to support the bottom of the hairdye collecting member 16, while on the upper portion of the block 15, there is formed a supporting part 22 for making the hairdye collecting member 16 settled on it.

The guiding flow path 20 of the block 15 receives the nozzle 11*b* of the tank 11, and the discharge pipe 19 of the side of the block 15 is inserted into the inlet of the hairdye collecting member 16, thereby forming a flow path through the hairdye collecting member 16.

In another embodiment of the present invention as shown in FIG. 5, there is provided a height difference C between the guiding flow path 20 of one of the block 15 and the guiding flow path 20 of another of the blocks 15. Thus owing to the height difference between the two guiding flow paths 20, the mixing of the hairdyes is promoted when they are mixed within the hairdye collecting member 16.

The hairdye collecting member 16 has a through-hole 23 formed through its both sides correspondingly with the discharge pipes 19 of the pair of the blocks 15, and an outlet 24 is formed at the center of the through hole 23 to form a flow path. Thus the hairdye collecting member 16 collects and combines the hairdyes coming from both of the blocks 15 to discharge the combined hairdye.

The diameter of the outlet 24 of the hairdye collecting member 16 is larger than that of the through hole 23 of the hairdye collecting member 16, and therefore, the combining and the supplying of the hairdye become smooth. The outlet 24 has threads 24*a* so that the guide pipe 17 can be fastened to it. An arm 16*a* protrudes from each of the sides of the hairdye collecting member 16, so that the hairdye collecting member 16 can be supported upon both of the blocks 15.

A flat supporting plate 25 is formed on the lower portion of the guide pipe 17, so that the guide pipe 17 can be settled upon the hairdye collecting member 16. Further, a threaded fastening part 26 is formed under the supporting plate 25, so that the fastening part 26 can be fastened into the outlet of the hairdye collecting member 16.

The push button 18 is provided with a push piece 27 at its center, and a pair of levers 28 protrude from both sides of the push button 18. The levers 18 are rotatably connected to each side of the push piece 27 such that when the push piece 27 is depressed the levers 28 rotate downward. If the user pushes down the push piece 27, then the levers 28 are pivoted to press down the blocks 15, so that the hairdyes would be ejected from the tank 11.

The brush 13 includes: a brush main body 29 assembled to the top of the nozzle pressing means 12; and a hairdye ejecting brush 30 detachably assembled to the brush main body 29, and connected to the guide pipe 17 to eject the hairdye.

The brush main body 29 is provided with a receiving slot 31 on a side thereof, for receiving the hairdye ejecting brush 30, while a plurality of comb blades 32 are formed around the receiving slot 31.

Figure 7:
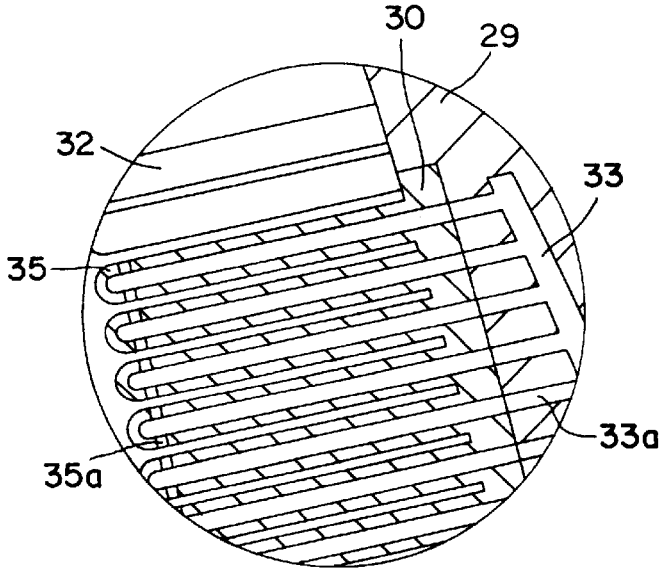
FIG. 7 is a side sectional view of the hairdye ejecting brush according to the present invention.
Figure 8A:
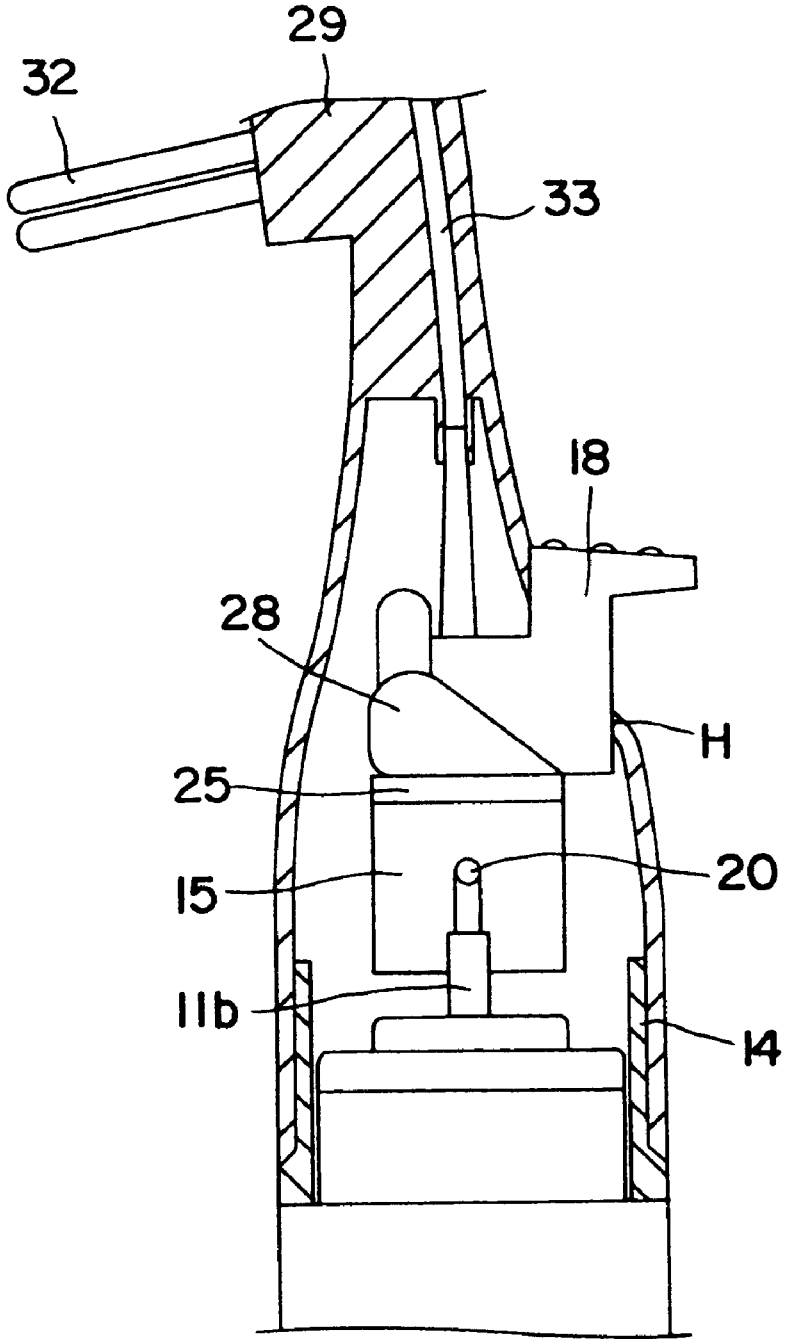
FIG. 8*a* is a side sectional view of the operating state of the nozzle pressing means according to the present invention, showing a status before pressing the push button.
Figure 8B:
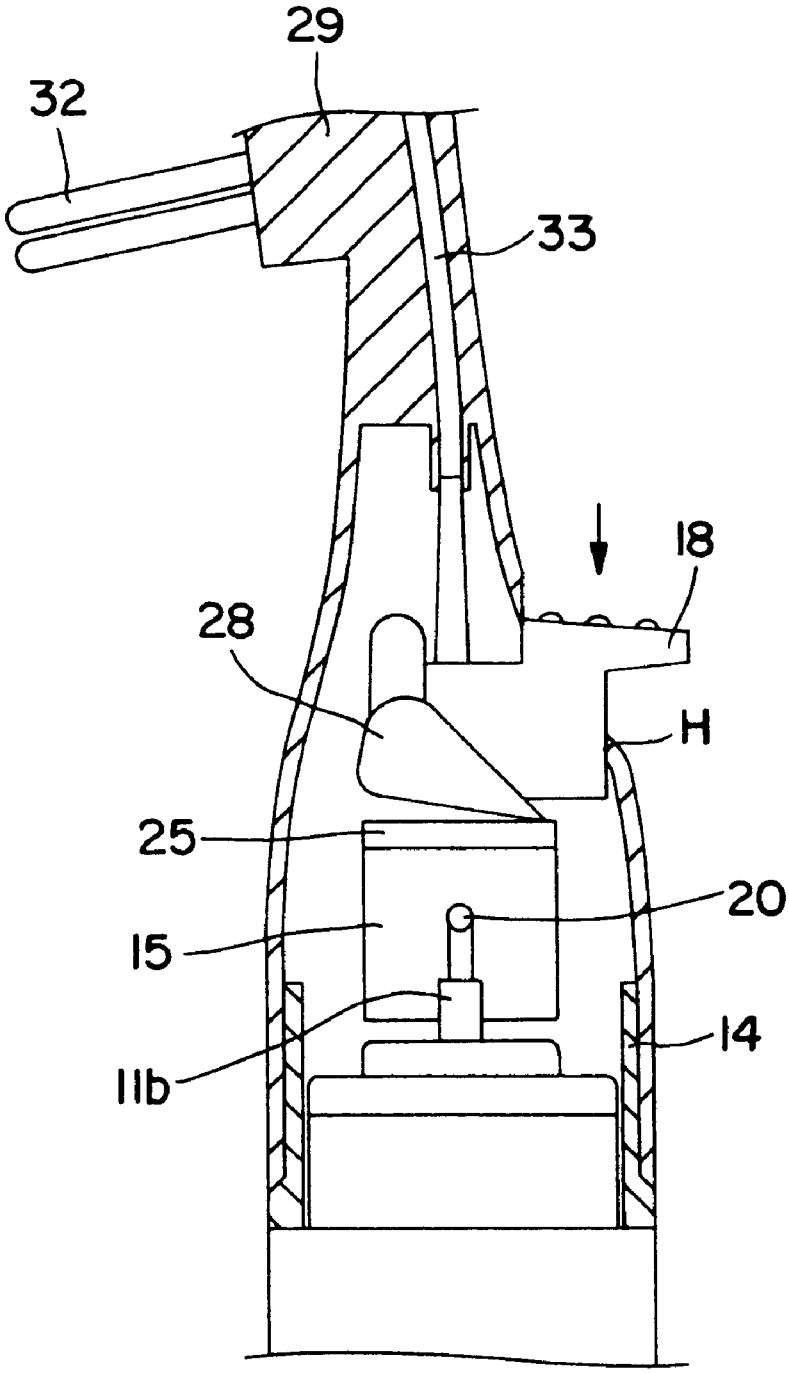
FIG. 8*b* is a side sectional view of the operating state of the nozzle pressing means according to the present invention, showing a status after pressing the push button to eject the is hairdye.

A conduit 33 is formed between the receiving slot 31 and a lower opening, so that the hairdye can flow toward the receiving slot 31. As shown in FIG. 7, the conduit 33 is provided with a plurality of branch conduits 33*a* correspondingly with the comb blades of the hairdye ejecting brush 30. Further, as shown in FIGS. 8*a* and 8*b,* a through guide hole H is formed on a side of the brush main body 29, so that the push piece 27 of the push button 18 can pass through it.

The hairdye ejecting brush 30 is provided with a plurality of hollow comb blades 35, and each of the hollow comb blades 35 has at least one or more outlets 35*a.*

The outlets 35*a* of the hollow hairdye ejecting comb blades 35 are provided at uniform gaps. However, it is preferable that they may well be provided more densely near the end portion.

The ejecting pressure of the hairdye is strong near the inlets of the internal conduits of the hairdye ejecting comb blades 35, but it is weakened accordingly as coming toward the ends. Therefore, as shown in FIG. 7, the hairdye outlets 35*a* are not formed alternately starting from the inlets up to the middle portion of the hairdye ejecting comb blades 35.

This is for achieving a balanced ejection of the hairdye by providing that the hairdye outlets 35*a* are more densely formed near the ends of the hairdye ejecting comb blades 35 than near the inlets of them.

Thus the hairdye ejecting brush 30 is assembled to the brush main body 29, in such a manner that the hairdye ejecting comb blades 35 are matched to the branch conduits 33*a* of the brush main body 29. In this manner, the first and second hairdyes which have passed through receiving slot 31 are ejected simultaneously.

Figure 9:
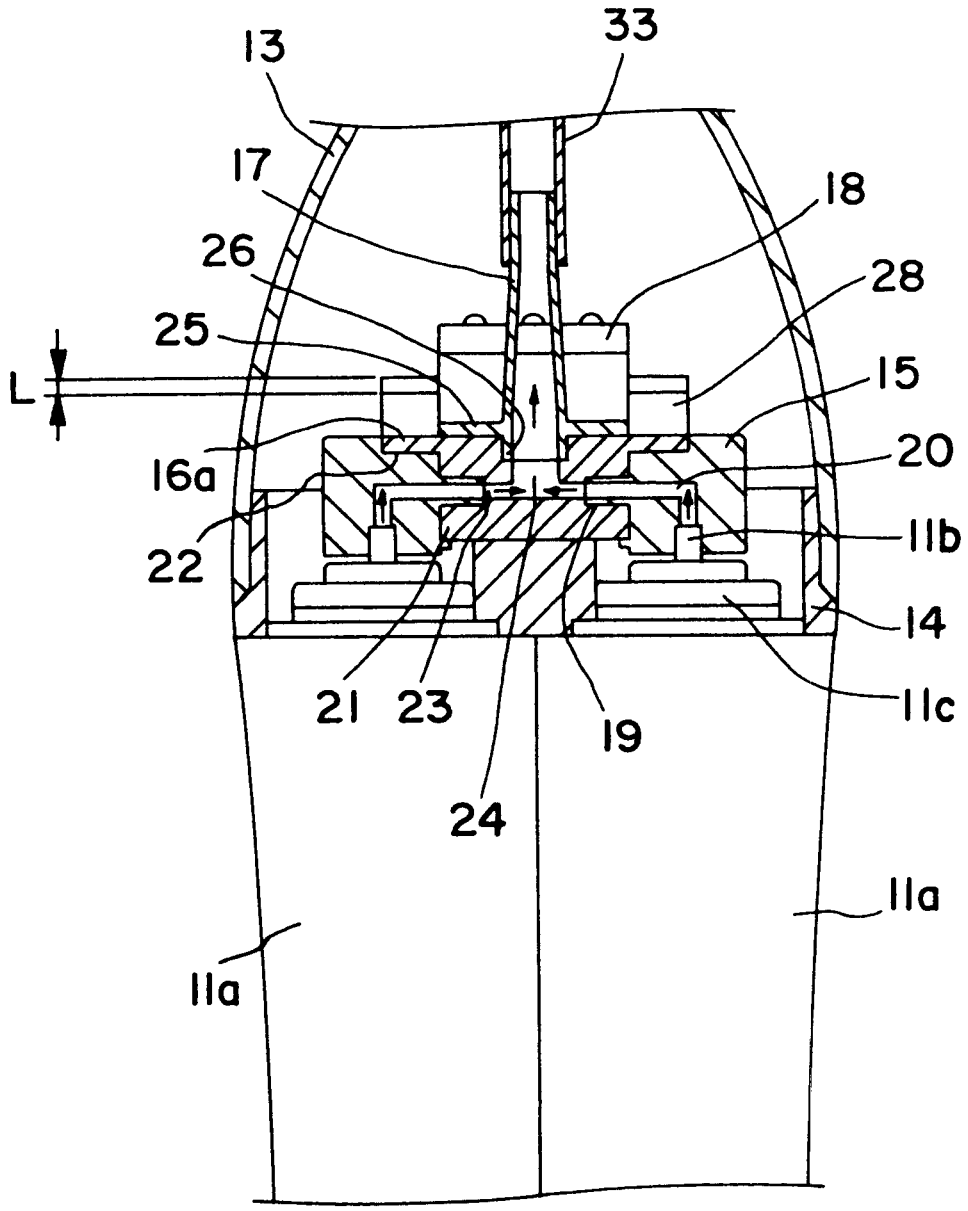
FIG. 9 is a frontal view showing a status in which the hairdye has been ejected by pushing the push button according to the present invention

Now the hairdye ejecting apparatus constituted as above will be described as to its use in detail referring to FIGS. 8*a*, 8*b* and 9.

FIG. 8*a* illustrates a status in which the hairdye has not been ejected. That is, it illustrates a status before pressing the push button 18. Here, the push button 18 is simply mounted upon the blocks 15.

In this state, if the push button 18 is pressed to dye or decolorize the hairs, then as shown in FIG. 8*b*, the levers 28 of the push button 18 are pivoted to push down the two blocks 15. Thus the blocks 15 come down as much as a distance L to press down the nozzles 11*b* of the tank 11.

Thus, the nozzles 11*b* are pushed down, and at the same time, the hairdyes within the tank 11 rise into the blocks 15 to be supplied into the hairdye collecting member 16 so as for the hairdyes to be mixed together within the outlet 24. Then the mixed hairdyes pass through the guide pipe 17 and the conduit 33 to reach the branch conduits 33*a*. Then the mixed hairdyes are ejected through outlets 35*a* of the hairdye ejecting comb blades 35 to the hairs of the user.

In this manner, the push button 18 is pressed down as much as the needed amount of the hairdye. Then each time when the push button is pressed, the first and second hairdyes are supplied from the two parts of the tank 11 into the hairdye collecting member 16 to be mixed there together so as to be ultimately supplied to the hairs of the user. Accordingly, this apparatus can be used in a continuous manner.

According to the present invention as described above, the first and second hairdyes are stored separately in the two storage vessels of the tank, and the two hairdyes are mixed together when they are used. Accordingly, the dying or decolorizing of the hairs can be carried out by one stroke of the brush, thereby providing a convenience.

Particularly, the hairdyes are ejected in a state with the comb blades deeply inserted into the hairs, and therefore, if the brush is stroked just several times, then the dying or decolorizing of the hairs is automatically completed. Accordingly, the apparatus of the present invention is drastically superior over the conventional ones.

What is claimed is:

1. A brush coupled to a hairdye ejecting apparatus, comprising:

a tank consisting of a pair of storage rooms for storing first and second hairdyes respectively, and each of the storage rooms having a nozzle, the nozzle protruding from an outlet of each of the storage rooms;

a nozzle pressing means installed at an outlet of the tank and having flow paths communicating to the nozzles and a push button having a first side and a second side including a push piece at its center and levers pivotally connected to each of said sides, for pressing down the nozzles of the tank by said levers so as to eject the hairdyes, for imposing a pressure on the nozzles to eject the hairdyes; and a brush coupled to the nozzle pressing means and having a plurality of comb blades, for ejecting the hair dyes by actuations of the nozzle pressing means.

2. The brush coupled to a hairdye ejecting apparatus as claimed in claim 1, wherein the nozzle pressing means further comprises:

a housing having a pair of through guide holes for receiving caps respectively, and assembled to an outlet part of the tank;

a pair of blocks accommodated within the housing, a bottom and a side face of each of the blocks providing access to a flow path, each flow path being connected to one of said nozzles of the tank, the push button mounted on said pair of blocks;

a hairdye collecting member disposed between the pair of the blocks, for being matched to outlets of the blocks to eject the hairdyes after receipt of them from the pair of blocks; and a guide pipe connected to an outlet of the hairdye collecting member, for guiding the hairdyes to the brush.

3. The brush coupled to a hairdye ejecting apparatus as claimed in claim 1, wherein the brush comprises:

a brush main body comprising: a receiving slot, the plurality of comb blades formed around the receiving slot; a conduit formed between the receiving slot and a lower opening so as to communicate to a guide pipe connected to an outlet of the hairdye collecting member and so as to make hairdye flow to the receiving slot; and a guide hole for making a push button protrude from a side; and a hairdye ejecting brush having a plurality of hairdye ejecting hollow blades, each of the blades having an outlet, the brush being detachably attached to the receiving slot of the brush main body to eject the hairdye.

4. A brush coupled to a hairdye ejecting apparatus, comprising:

a tank consisting of a pair of storage rooms for storing first and second hairdyes respectively, and each of the storage rooms having a nozzle, the nozzle protruding from an outlet of each of the storage rooms;

a nozzle pressing means installed at an outlet of the tank and having flow paths communicating to the nozzles, for imposing a pressure on the nozzles to eject the hairdyes, said nozzle pressing means including a housing having a pair of through guide holes for receiving caps respectively, and assembled to an outlet part of the tank, a pair of blocks accommodated within the housing, a bottom and a side face of each of the blocks providing access to a flow path each the flow path being connected to one of said nozzles of the tank, a hairdye collecting member disposed between the pair of the blocks, for being matched to outlets of the blocks to eject the hairdyes after receipt of them from the pair of blocks, a guide pipe connected to an outlet of the hairdye collecting member, for guiding the hairdes to the brush, and a push button mounted upon the pair of the blocks and having a push piece at its center and having levers on its sides, for pressing down the nozzles of the tank by levers so as to eject the hairdyes.; and a brush coupled to the nozzle pressing means and having a plurality of comb blades, for ejecting the hair dyes by actuation of the nozzle pressing means;

wherein there is a height difference between the flow paths of the two blocks.

5. The brush coupled to a hairdye ejecting apparatus as claimed in claim 3, wherein a plurality of outlets are formed in the hairdye comb blades at uniform gaps, but the outlets are not formed alternately from inlets to middle portions of the hairdye ejecting hollow blades.

* * * * *

UNITED STATES PATENT AND TRADEMARK OFFICE

CERTIFICATE OF CORRECTION

PATENT NO. : 6,505,983 B1
DATED : January 14, 2003
INVENTOR(S) : Dong Kook Seo

It is certified that error appears in the above-identified patent and that said Letters Patent is hereby corrected as shown below:

Column 6,
Line 50, "hairdes" should be -- hairdyes --

Signed and Sealed this

Twenty-second Day of April, 2003

JAMES E. ROGAN
*Director of the United States Patent and Trademark Office*